US009089884B2

(12) United States Patent
Rankin et al.

(10) Patent No.: US 9,089,884 B2
(45) Date of Patent: Jul. 28, 2015

(54) PIPELINE DEBRIS SHEARING DEVICE

(75) Inventors: William J. Rankin, Sapulpa, OK (US); Matthew W. Logan, Broken Arrow, OK (US); Robert F. Strong, Collinsville, OK (US)

(73) Assignee: TDW Delaware, Inc., Wilmington, DE (US)

( * ) Notice: Subject to any disclaimer, the term of this patent is extended or adjusted under 35 U.S.C. 154(b) by 166 days.

(21) Appl. No.: 12/840,049

(22) Filed: Jul. 20, 2010

(65) Prior Publication Data

US 2012/0017386 A1 Jan. 26, 2012

(51) Int. Cl.
*B08B 9/055* (2006.01)

(52) U.S. Cl.
CPC ..... *B08B 9/0557* (2013.01)

(58) Field of Classification Search
CPC ..... B08B 9/0557; B08B 9/0553; B08B 2209/055; F16L 55/26; F16L 55/38
USPC ..... 15/104.061, 3.5, 104.16
See application file for complete search history.

(56) References Cited

U.S. PATENT DOCUMENTS

| | | | | | |
|---|---|---|---|---|---|
| 555,976 | A | * | 3/1896 | Secor | 15/104.16 |
| 2,170,997 | A | * | 8/1939 | Griffin | 15/104.061 |
| 3,047,895 | A | | 8/1962 | Ver Nooy | |
| 3,496,588 | A | | 2/1970 | Ver Nooy | |
| 3,576,043 | A | | 4/1971 | Zongker | |
| 3,604,041 | A | | 9/1971 | Ver Nooy | |
| 3,868,773 | A | | 3/1975 | Province | |
| 3,879,790 | A | | 4/1975 | Girard | |
| 3,906,577 | A | | 9/1975 | Brucher | |
| 4,083,074 | A | * | 4/1978 | Curtis | 15/104.061 |
| 4,292,704 | A | | 10/1981 | Joanis, Sr. | |
| 5,295,279 | A | * | 3/1994 | Cooper | 15/104.061 |
| 5,600,863 | A | * | 2/1997 | Curran | 15/104.061 |
| 5,617,604 | A | | 4/1997 | Erich | |
| 5,625,917 | A | | 5/1997 | Hawkins | |
| 5,903,946 | A | | 5/1999 | Collins et al. | |
| 6,065,174 | A | | 5/2000 | Laymon | |
| 6,067,682 | A | * | 5/2000 | Rankin | 15/104.061 |
| 6,173,469 | B1 | | 1/2001 | Laymon | |
| 6,464,010 | B1 | | 10/2002 | Brown | |

(Continued)

FOREIGN PATENT DOCUMENTS

| | | | |
|---|---|---|---|
| EP | 0698423 | | 1/1999 |
| GB | 2034431 | A * | 6/1980 |

(Continued)

*Primary Examiner* — Todd Manahan
*Assistant Examiner* — Brianne Kalach
(74) *Attorney, Agent, or Firm* — Gable & Gotwals

(57) ABSTRACT

A pipeline debris shearing device includes a forwardly positioned, self sharpening, wear compensating, diameter conforming elastomeric member that forms a peeling edge having a negative rake angle to peel away debris from the internal wall of a pipeline. The peeling edge is formed at the point of meeting between a concave-shaped, curved forward face surface and a substantially straight outer peripheral surface. Radial slots may be provided to lessen the force being exerted on the peeling edge and provide for bypass flow to carry away debris removed by the peeling edge. Spaced-apart narrow stripper teeth may be added to help in removing harder deposits of debris. The peeling edge may be arranged substantially perpendicular the central longitudinal axis of the pipeline pig or arranged oblique to it. Further, the peeling edge may spiral about at least a portion of the pipeline pig.

4 Claims, 9 Drawing Sheets

(56) References Cited

U.S. PATENT DOCUMENTS

| | | | |
|---|---|---|---|
| 6,581,235 | B1 | 6/2003 | Stocco |
| 6,792,820 | B2 | 9/2004 | Wentworth et al. |
| 7,000,280 | B1 | 2/2006 | Knapp |
| 2002/0095736 | A1 | 7/2002 | Savard |
| 2003/0056309 | A1 | 3/2003 | Savard |

FOREIGN PATENT DOCUMENTS

| | | |
|---|---|---|
| JP | 1231980 | 9/1989 |
| JP | 5306795 | 11/1993 |
| JP | 6238249 | 8/1994 |
| JP | 2006095441 | 4/2006 |
| WO | WO 2010/012087 | 2/2010 |

* cited by examiner

PIPELINE DEBRIS SHEARING DEVICE

BACKGROUND

The present invention relates generally to pipeline pigs used for inspecting, maintaining and servicing piping systems and pipelines. More specifically, the present invention relates to pipeline pigs used for cleaning, namely, pigs with means for scraping and loosening debris from the inner wall of the pipe.

Pipeline pigs are frequently employed in pipelines for a variety of services and are typically constructed to move by the force of fluid flow through a pipeline. The fluid may be in the form of water, petroleum products such as gasoline, diesel fuel, crude oil, propane, and so forth, or may be in the form of gas, such as natural gas. One of the primary reasons for sending a pig through a pipeline is to clean the interior of the pipeline of foreign matter, such as paraffin, dirt, sand, rocks, welding wire ends, scale, and water.

A cleaning pig typically includes a body which is supported centrally within the pipeline, the body having an external diameter of significantly less than the internal diameter of the pipeline. To this pig body is supported discs or cups for contacting the wall of the pipeline. The cups or discs serve several purposes. First, they serve to support the pig body centrally within the pipeline. Second, at least one of the discs serves to seal the pipeline so the pig may be moved through the pipeline by the force of fluid flow. The third basic function of such discs is to contact the inner wall of the pipeline to scrape away scale or other foreign matter.

One problem with current scraping disc or cup designs is that the disc is not self-sharpening. Another problem is that the disc does not compensate for wear caused by continuous contact with the inner wall of the pipeline. Still yet another problem is that the disc does not readily conform to the inside surface of the pipeline while at the same time providing for longer wear life. Therefore, a need exists for an improved scraping disc or cup design.

SUMMARY OF THE INVENTION

A pipeline debris shearing device made according to this invention includes an elastomeric member that forms a peeling edge having a negative rake angle which engages and peels away debris from the internal wall of a pipeline. The peeling edge is formed at the point of meeting between a concave-shaped, curved forward face surface and a substantially straight outer peripheral surface. The elastomeric member, which has means for mounting to a pipeline pig, is oversized relative to the inside diameter of the pipe or pipeline so that in a pipeline-restrained position, the elastomeric member urges radially outward and the peeling edge engages the debris. Means may also be provided to assist the elastomeric member in urging radially outward. Because the elastomeric member is oversized, the member compensates for wear as it travels through the interior of the pipeline, peeling away debris.

The elastomeric member may be in the form of a disc, a cup, diagonally oriented blades, or individual segments that when combined with other segments and mounted to a pipeline pig body give the appearance of a disc or cup. Radial slots may be provided to lessen the force being exerted on the peeling edge and provide for bypass flow to carry away debris removed by the peeling edge. Spaced-apart narrow stripper teeth may be added to help in removing harder deposits of debris. The peeling edge may be arranged substantially perpendicular the central longitudinal axis of the pipeline pig or arranged oblique to it. Further, the peeling edge may spiral about at least a portion of the pipeline pig.

An object of this invention is to provide a forwardly positioned, self sharpening, wear compensating, diameter conforming, paraffin and debris removing tool that may be mounted on a pipeline pig and used for the purpose of peeling away the paraffin and debris from the inner wall surface of a pipe or pipeline so as to avoid the progressive build-up of the paraffin and debris.

DETAILED DESCRIPTION OF THE PREFERRED EMBODIMENTS

Figure 1:
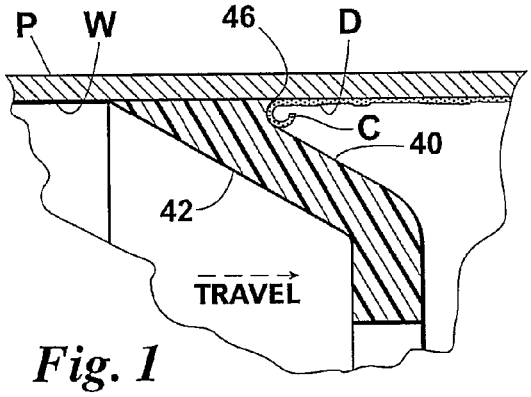
FIG. 1 is a view of the circumferential outer portion of a cup-type elastomeric member made according to this invention in its pipeline-restrained position. A shearing or peeling edge having a negative rake angle is formed at the point of meeting between a concave-shaped curvature located on the forward face surface of the circumferential outer portion and an outer peripheral surface.
Figure 2:
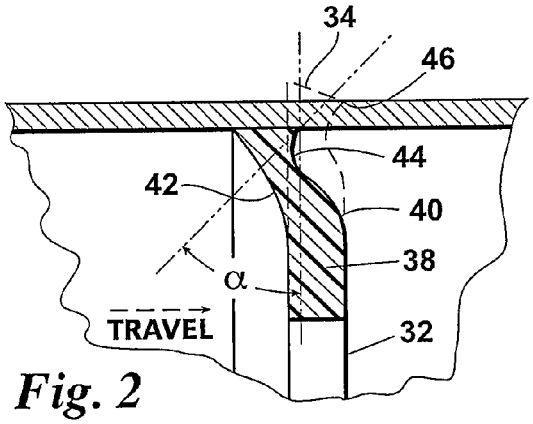
FIG. 2 is a view of the circumferential outer portion of a disc-type elastomeric member made according to this invention in its free position and in its pipeline restrained position. When in the pipeline-restrained position, the elastomeric conforms to the inside diameter of the pipeline and continuously urges outward against its inner wall surface.

Preferred embodiments of a pipeline debris shearing device made and used according to this invention are described below with reference to the drawings and the following elements illustrated in the drawings:

10 Elastomeric member
11 Disc
13 Cup
15 Segmented disc
17 Segmented cup
19 Stripper disc
21 Stripper cup
23 Multi-ribbed blade
25 Single blade
27 Cup -continued 29 Foam pig
32 Inner portion
34 Outer peripheral surface
36 Center
38 Outer portion
39 Attachment means
40 Forward face
42 Rearward face
44 Curvature
46 Point of 34 & 44 meeting/peeling edge
48 Radial slot
50 Upper end of 48
52 Lower end of 48
54 Bypass pathway
56 Teeth
58 Leaf type springs Referring to the drawings and first to FIGS. 1 and 2, a pipeline debris shearing device made according to this invention has an elastomeric member 10 that forms a shearing or peeling edge 46 which peels away debris D such as paraffin from the inner wall surface W of a pipe or pipeline P as the pipeline pig to which elastomeric 10 is mounted moves forward under differential pressure through the interior space of pipeline P. The negative rake angle $\alpha$ of peeling edge 46 is selected so that as peeling edge 46 peels away the debris D, chip C forms. The loosened debris D (or chip C) may then be pushed out of the pipeline P by cups, discs, or an integrated bypass flow through the pipeline pig.

Figure 3:
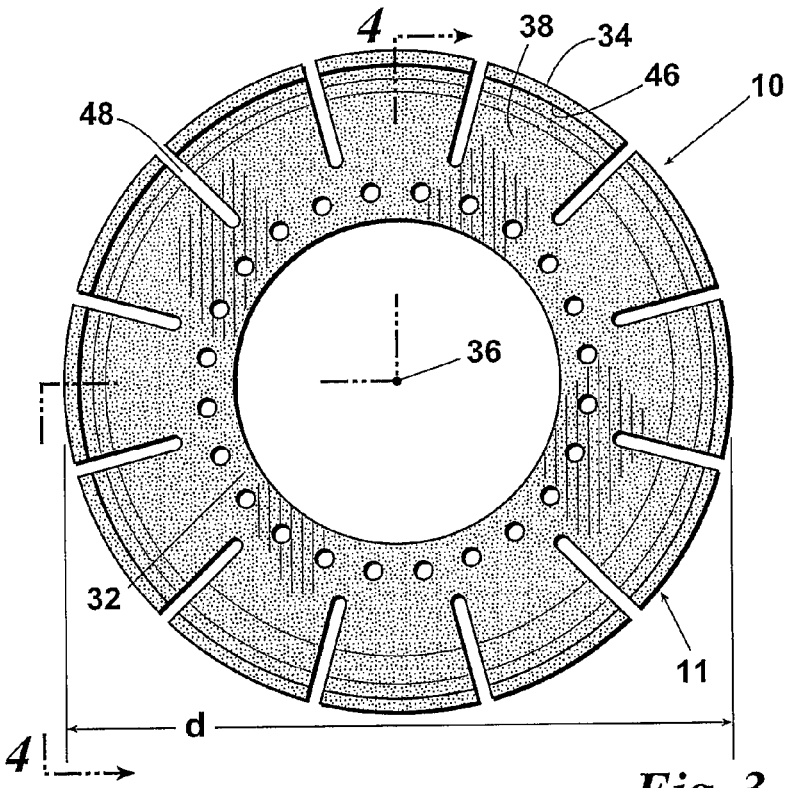
FIG. 3 is a front view of a disc embodiment of the elastomeric member of FIG. 2, shown in the free position. The radial slots allow the circumferential outer portion to more readily conform to the inner wall of the pipeline while also providing longer wear life to the peeling edge.

The elastomeric member 10 is sized so that in its free state or position—that is, when elastomeric member 10 is not residing within the interior space of a pipeline—its outside diameter "d" is greater than the inside diameter of the pipeline (see e.g., FIG. 3). When in the pipeline-restrained position (see e.g., FIG. 4), the member 10 conforms to the inside diameter of the pipeline P and continuously urges outward against its inner wall surface W. Because elastomeric 10 is oversized relative to the pipeline P, the member 10 compensates for wear as the pig travels forward. Further, resilient and abrasion-resistant properties of member 10 allow peeling edge 46 to self-sharpen and effectively shear the debris D from the wall surface W.

Peeling edge 46 is a forwardly positioned peeling edge, formed at the point of meeting between a concave-shaped curvature 44 located on the forward face surface 40 of the circumferential outer portion 38 of elastomeric member 10 and an outer peripheral surface 34 of member 10. The circumferential outer portion 38, when in the free position, generally extends angularly downward from the rearward face surface 42 toward the forward face surface 40. When in the pipeline-restrained position, circumferential outer portion 38 conforms to the pipeline P and orients itself generally substantially parallel to the wall surface W.

Figure 8:
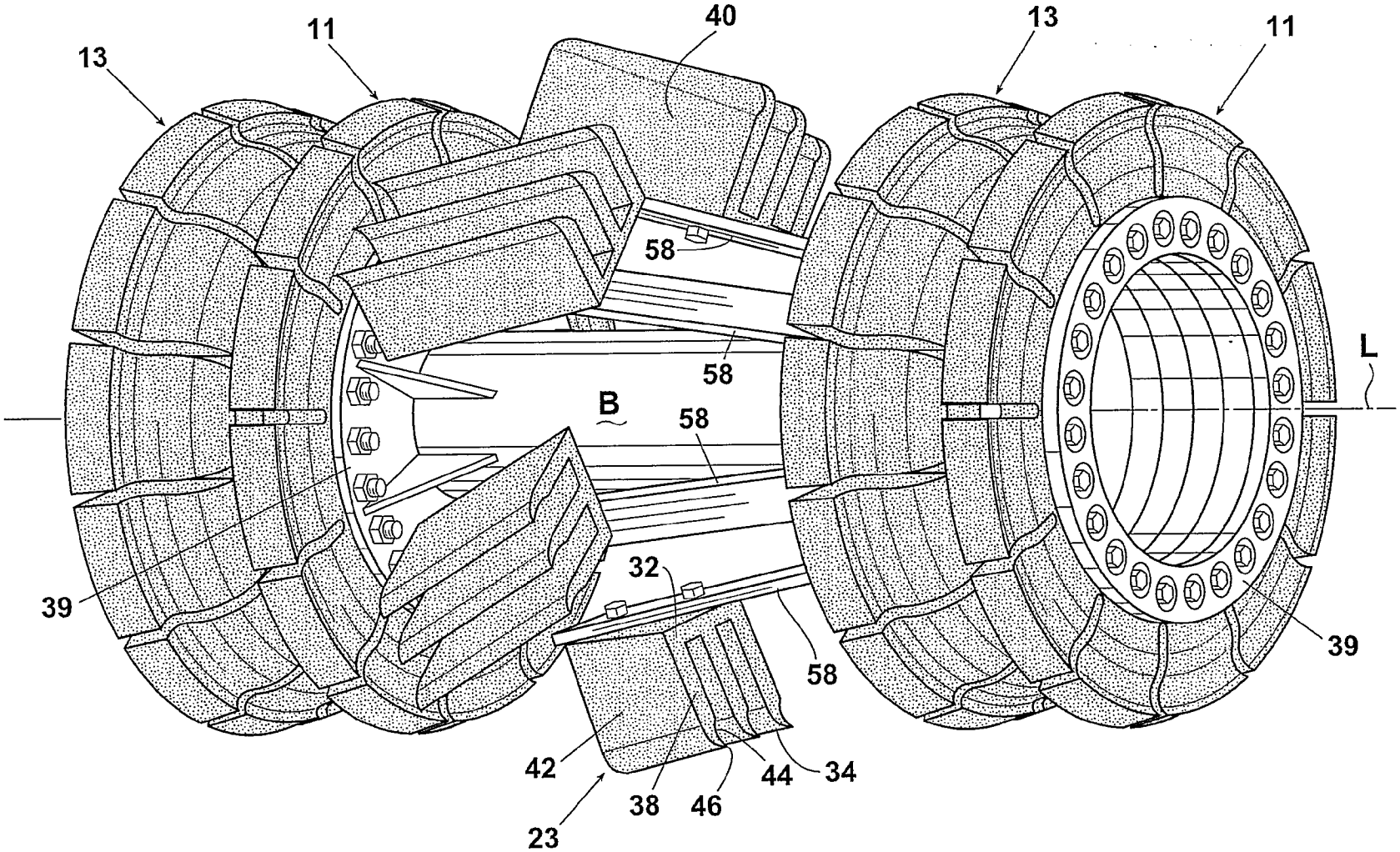
FIG. 8 is a view of a pipeline pig having the disc embodiment of FIGS. 3 to 5 and cup embodiment of FIGS. 1 and 6 mounted at a forward and rearward end of a pipeline pig. The pig also includes a multi-ribbed blade embodiment of the elastomeric member of FIG. 1. The multi-ribbed blades may be mounted on leaf springs or other means for urging the blades against the pipeline wall.

The circumferential outer portion 38 extends from an inner portion 32 which is of a selected thickness "t" and circumferentially arranged about the longitudinal body B of the pipeline pig (see e.g., FIG. 8). Outer peripheral surface 34 is normally concentric with the center 36 of inner portion 32. Means 39 for attaching inner portion 32 to a pipeline pig body B are provided so that elastomeric member 10 lies in a plane generally perpendicular the longitudinal axis L of the pig body B.

Figure 4:
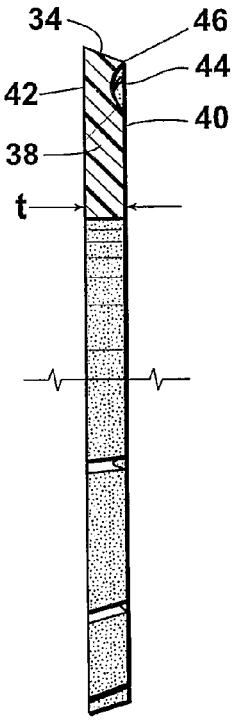
FIG. 4 is a section view of the disc embodiment of FIG. 3 taken along section line 4-4 of FIG. 3.
Figure 5:
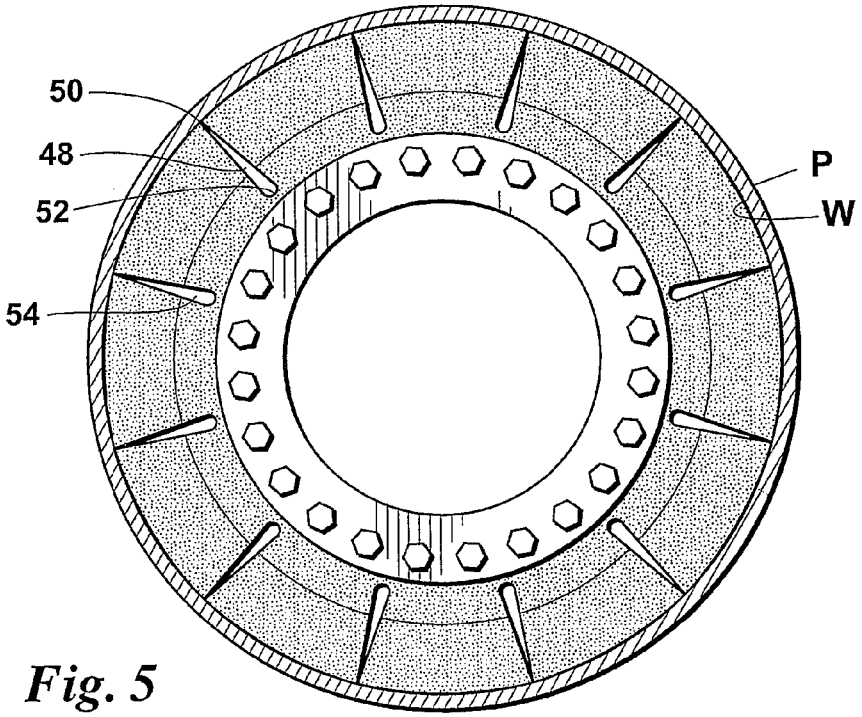
FIG. 5 is a view of the disc embodiment of FIG. 3 shown in the pipeline restrained position. When the disc is in the pipeline-restrained position and urging against the inner wall of pipeline, the disc flexes, thereby closing each radial slot toward its upper end 50 but allowing bypass flow through the slot toward its lower end.

The preferred embodiments of elastomeric member 10 described herein form a peeling edge 46 as described above. Referring first to FIGS. 3 to 5, elastomeric member 10 is a generally flat, oversized disc 11 with a plurality of radial slots 48. The radial slots 48 allow the circumferential outer portion 38 to more readily conform to the inner wall W of the pipeline P while also providing longer wear life. The longer wear life results from less outward force being exerted on the peeling edge 46 and from providing some bypass flow for carrying debris D away from edge 46. When disc 11 is in the pipeline-restrained position with circumferential outer portion 38 urging against the inner wall W of pipeline P, disc 11 flexes, thereby closing or narrowing radial slot 48 toward its upper end 50 but remaining wide toward its lower end 52 to create a bypass pathway 54.

Figure 7:
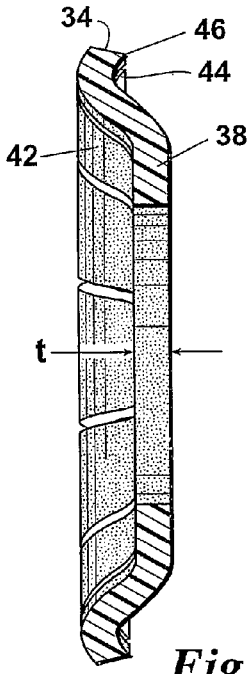
FIG. 7 is a section view of a differently shaped cup embodiment taken along section line 7-7 of FIG. 6.
Figure 6:
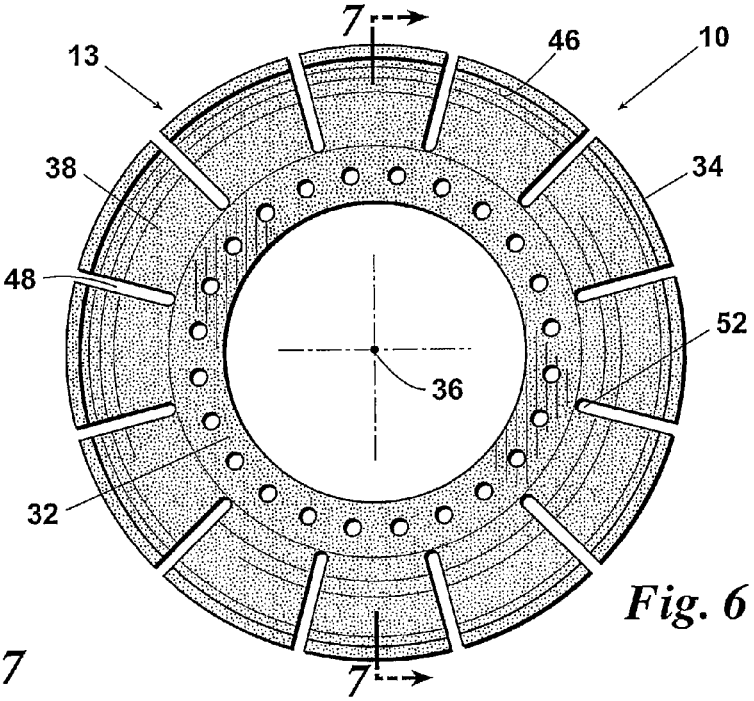
FIG. 6 is a front view of a cup embodiment of the elastomeric member of FIG. 1, shown in the free position. The radial slots perforin the same function as those in the disc embodiment of FIGS. 3 to 5.
Figure 13:
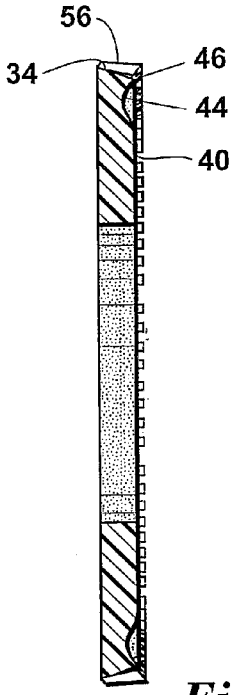
FIG. 13 is a section view of the stripper disc embodiment of FIG. 12 taken along section line 13-13 of FIG. 12.
Figure 12:
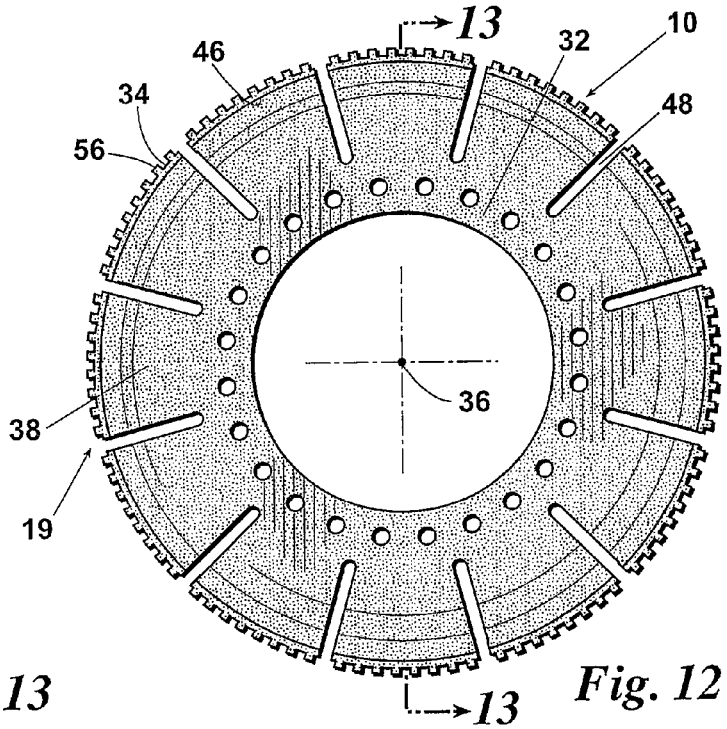
FIG. 12 is a front view of a stripper disc embodiment of the elastomeric member of FIG. 1 shown in its free position. Spaced-apart narrow stripping teeth are provided in combination with radial slots to provide a large outward force to break up harder deposits of debris.

Turning now to FIGS. 6 & 7, elastomeric member 10 is a cup 13, rather than a flat disc 11, but still having a plurality of radial slots 48. Similar to disc 11, when cup 13 is in the pipeline-restrained position (not shown), cup 13 flexes and bypass flow flows through the now teardrop shaped slot 48. Similar to disc 11 and cup 13 are a disc 15 and cup 17, respectively, made up of individual disc or cup segments which, when installed on a pipeline pig, have the general appearance to that of a disc or cup, respectively (see FIGS. 17 to 22).

Figure 15:
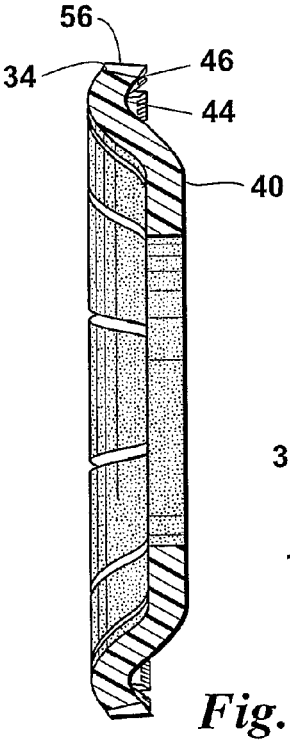
FIG. 15 is a section view of the stripper cup embodiment of FIG. 14 taken along section line 15-15 of FIG. 14.
Figure 14:
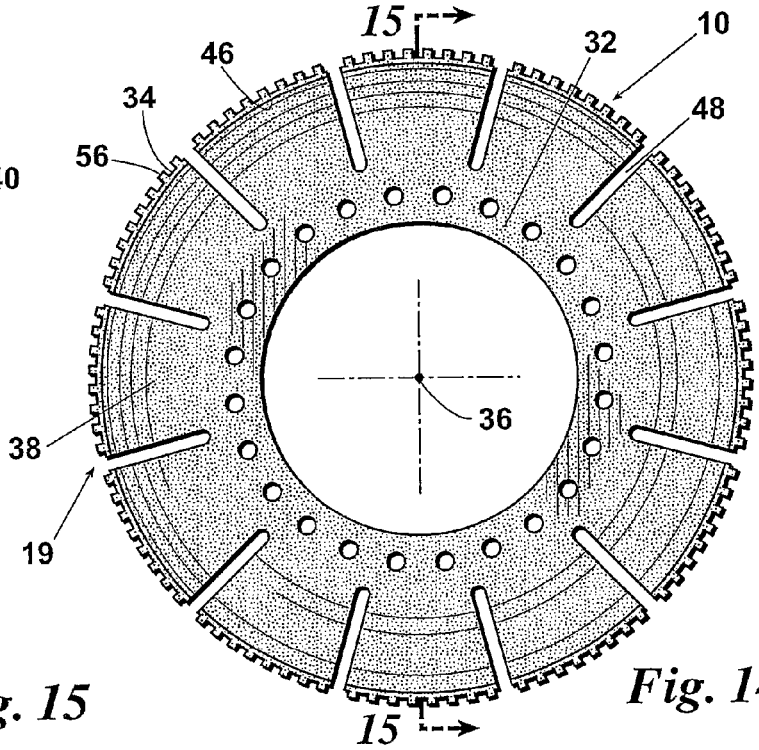
FIG. 14 is a front view of a stripper cup embodiment of the elastomeric member of FIG. 1 shown in its free position. Similar to the stripper disc of FIG. 12, spaced-apart narrow stripping teeth are provided in combination with radial slots to provide a large outward force to break up harder deposits of debris.

Turning now to FIGS. 12 to 15, elastomeric member 10 may also be a generally flat disc 19 with spaced-apart narrow stripping teeth 56 (FIGS. 12 and 13) or a cup 21 with stripping teeth 56 (FIGS. 14 and 15). Teeth 56 are preferably an integral part of the disc or cup rather than part of an insert mounted to the disc 19 or cup 21. The disc 19 or cup 21, in combination with teeth 56 (and slots 48), provide a large outward force to break up harder deposits of debris D.

Figure 16:
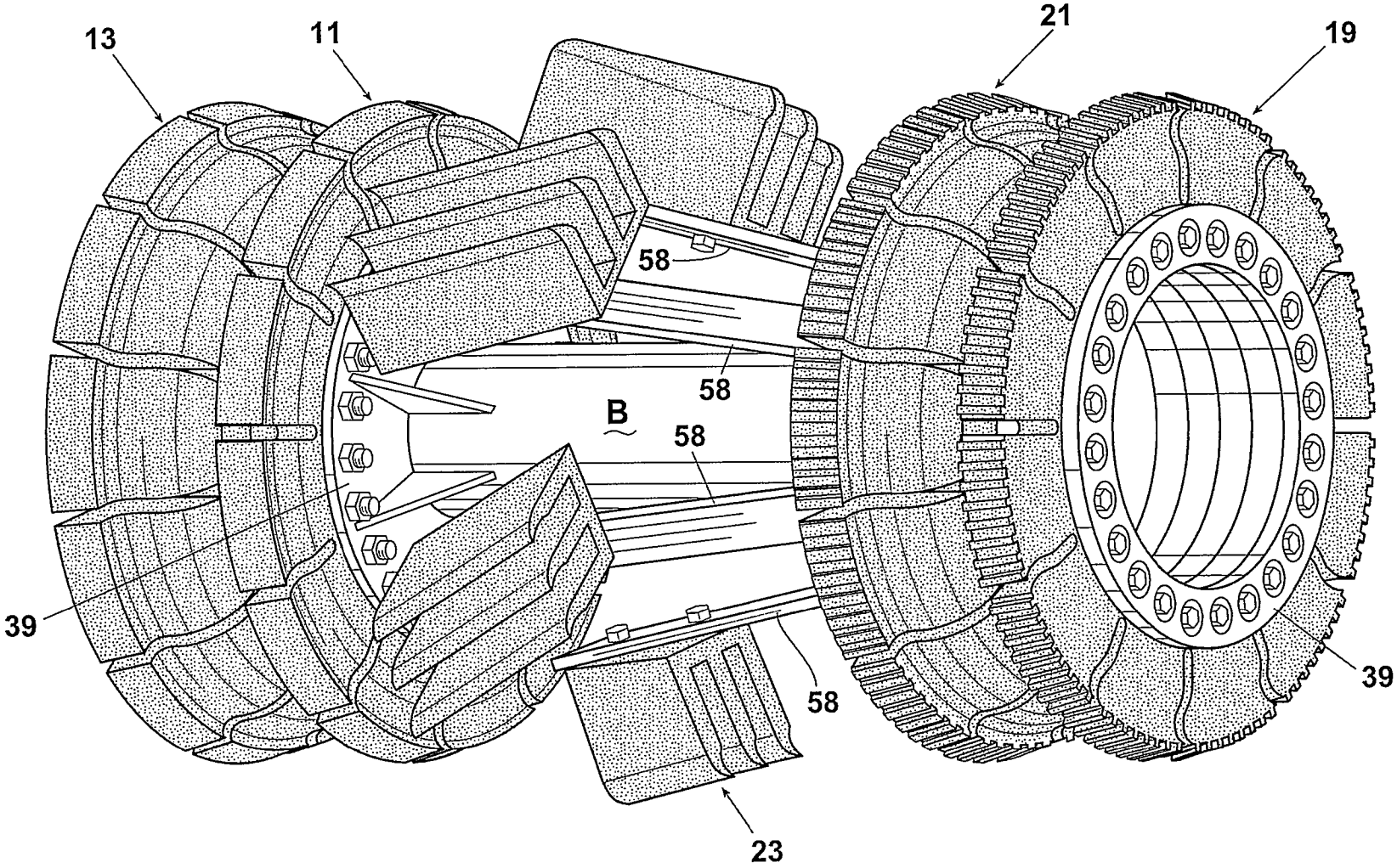
FIG. 16 is an isometric view of a pipeline pig having the disc embodiment of FIGS. 3 to 5 and cup embodiment of FIGS. 6 and 7 mounted at rearward end of a pipeline pig. Mounted at the forward end are the stripper disc embodiment of FIGS. 12 and 13 and the stripper cup embodiment of FIGS. 14 and 15. The pig also includes the multi-ribbed blade embodiment of FIG. 8.
Figure 17:
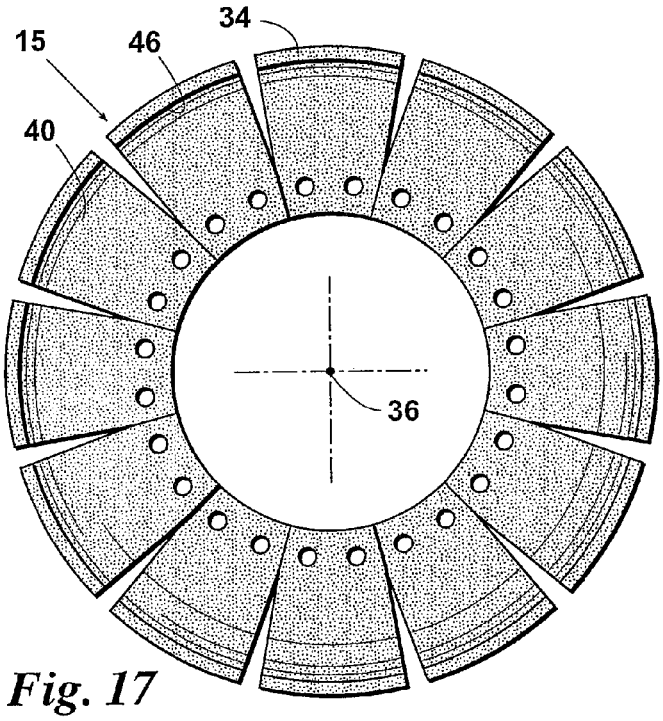
FIG. 17 is a front view of a segmented disc embodiment of the elastomeric member of FIG. 4. Individual disc segments are used that, when installed on a pipeline pig, have the general appearance to that of a disc.
Figure 18:
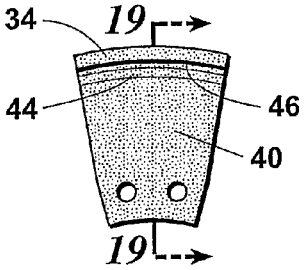
FIG. 18 is a front view of an individual disc segment of the segmented disc embodiment of FIG. 17.
Figure 19:
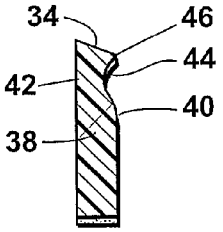
FIG. 19 is a section view of the disc segment of FIG. 18 taken along section line 19-19 of FIG. 18.
Figure 21:
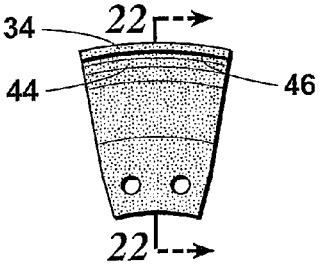
FIG. 21 is a front view of an individual cup segment of the segmented cup embodiment of FIG. 20.
Figure 22:
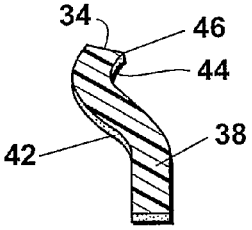
FIG. 22 is a section view of the cup segment of FIG. 21 taken along section line 22-22 of FIG. 21.
Figure 20:
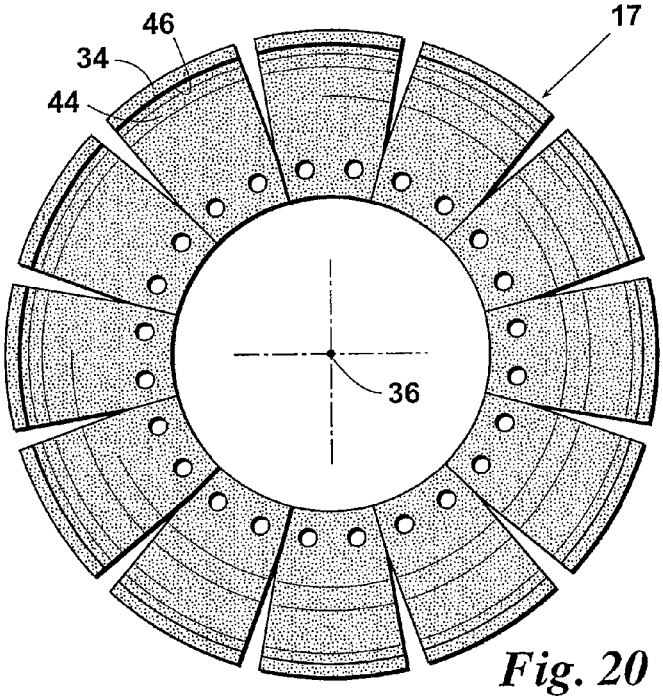
FIG. 20 is a front view of a segmented cup embodiment of the elastomeric member of FIG. 1. Individual cup segments are used that, when installed on a pipeline pig, have the general appearance to that of a disc.

Disc 11 and cup 13, or stripper disc 19 and stripper cup 21, may be used in combination on the same pig body B. (See FIGS. 8 and 16) An elastomeric member 10 in the form of a multi-ribbed blade 23 may be juxtaposed between forward cup 13 and rearward disc 11. The multi-ribbed blades 23 may also be used alone or in combination with other embodiments of elastomeric member 10 disclosed herein. The blades 23 may be mounted about pig body B on a cup or other radial pig component (not shown) or, if more outward radial force is desired against inner pipeline wall W, the blades 23 may be mounted on leaf-type springs 58. The blades are arranged oblique to the longitudinal axis L of pig body B.

Figure 9:
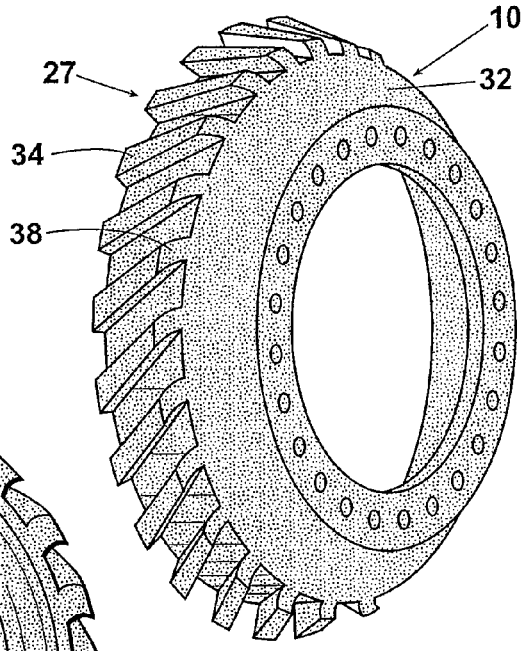
FIG. 9 is an isometric view a cup embodiment of the elastomeric member of FIG. 1 having the peeling edges oriented on a diagonal to the central longitudinal axis of the pipeline (see FIG. 11). In this, as in other, embodiments, means are provided for mounting the member to a pipeline pig body.
Figure 10:
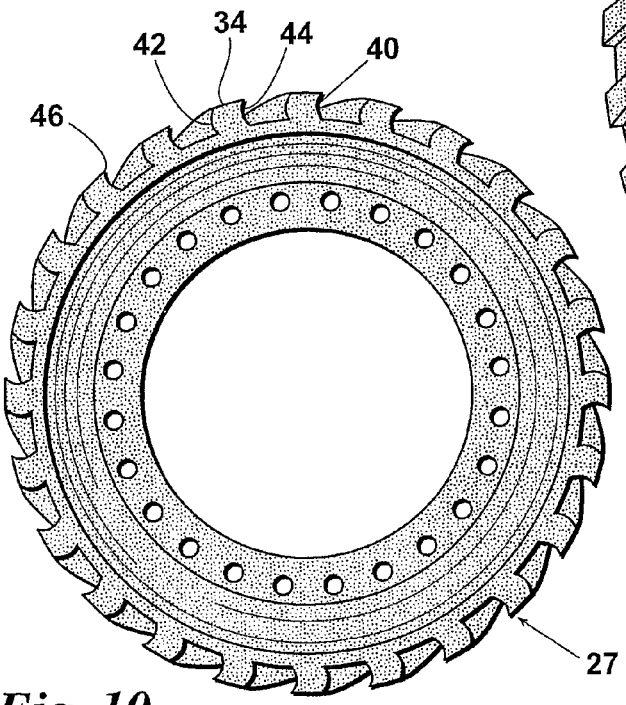
FIG. 10 is a rear view of the cup embodiment of FIG. 9.
Figure 11:
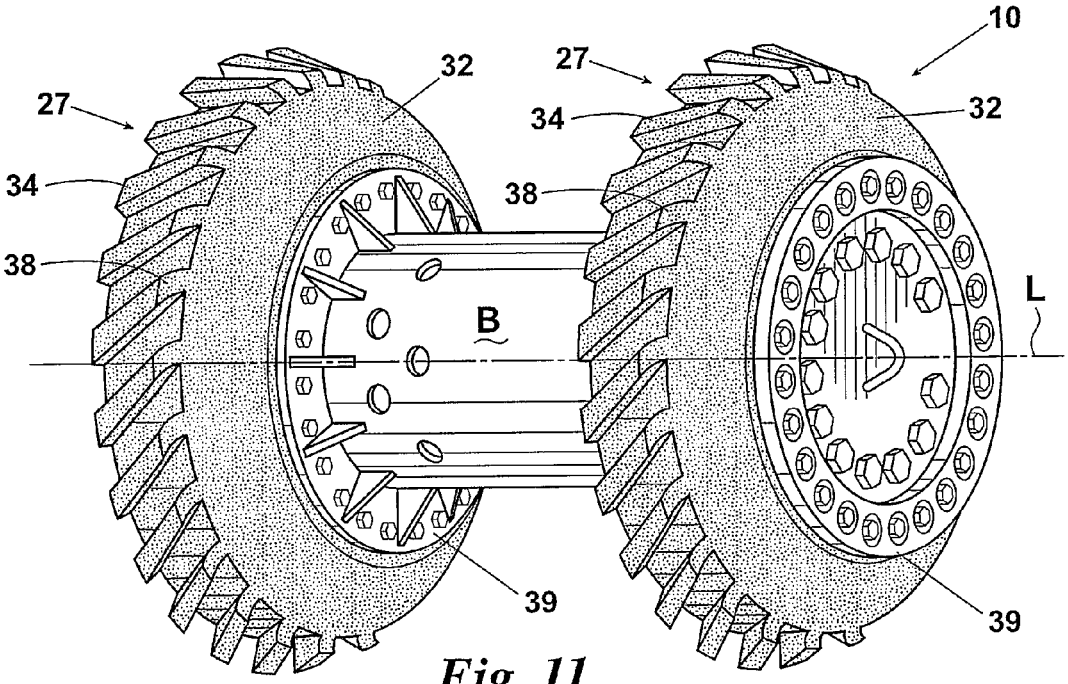
FIG. 11 is a view of the cup embodiment of FIG. 9 mounted at a forward and rearward end of a pipeline pig.
Figure 24:
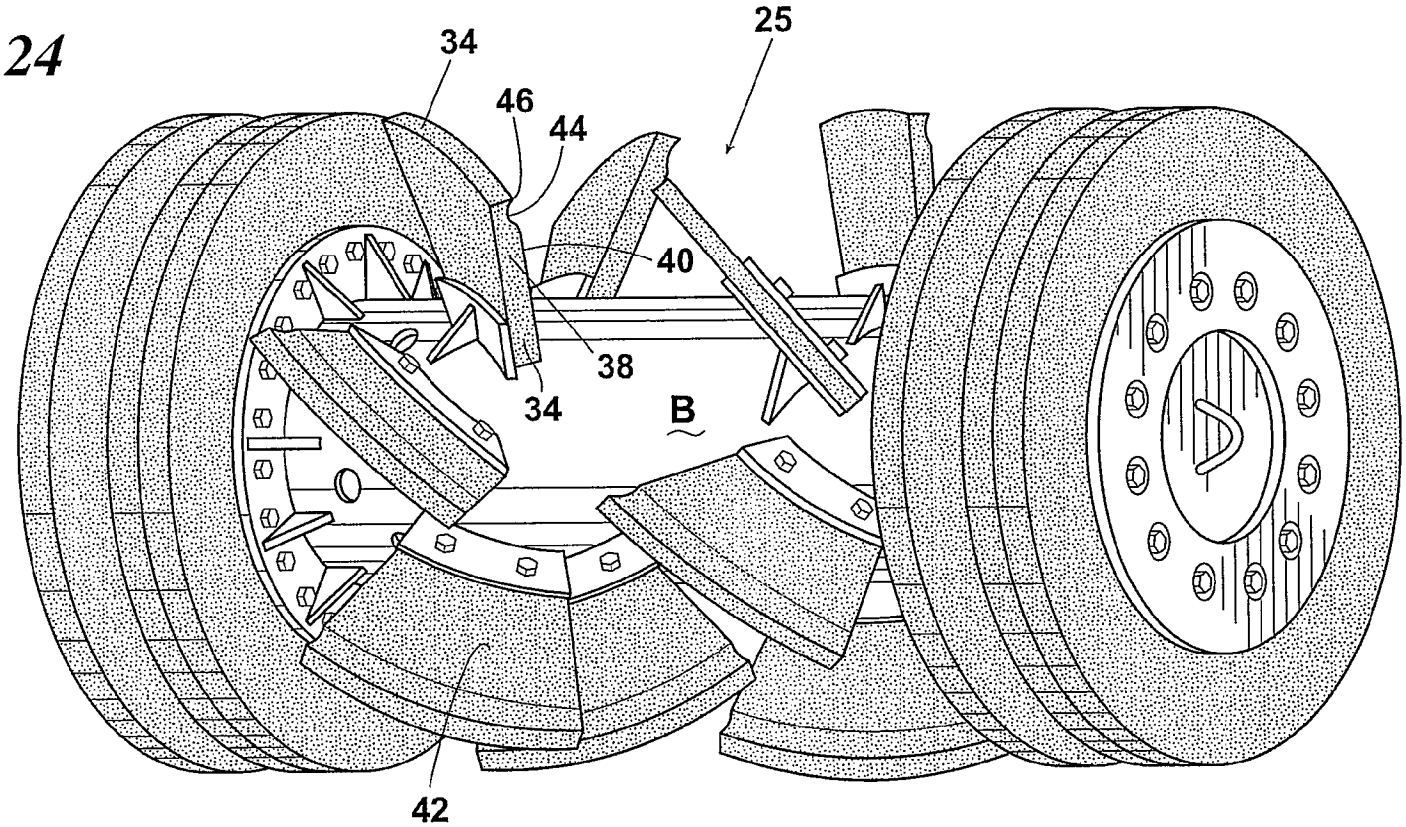
FIG. 24 is an isometric view of a pipeline pig having a plurality of diagonally oriented blade embodiments of the elastomeric member of FIG. 18. Mounted at the forward end and rearward end are sealing discs of a type well known in the art. These discs may be replaced by other cup and disc embodiments disclosed herein.
Figure 23:
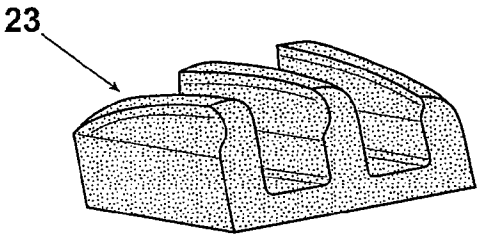
FIG. 23 is an isometric view of the multi-ribbed blade embodiment first illustrated in FIG. 8.

Other embodiments of elastomeric member 10 also employ peeling edges 46 arranged oblique to the longitudinal axis L of the pig body B. In FIGS. 9 to 11, elastomeric member 10 is a cup 27 with diagonally oriented peeling edges 46. In FIG. 24, elastomeric member 10 is in the form of individual blades 25 located about the pig body B and between sealing members of a type well known in the art. Similar to multi-ribbed blades 23, blades 25 or cup 27 (or both) may be used in combination with other embodiments of elastomeric member 10. (See e.g. FIGS. 8 and 16.)

Figure 26:
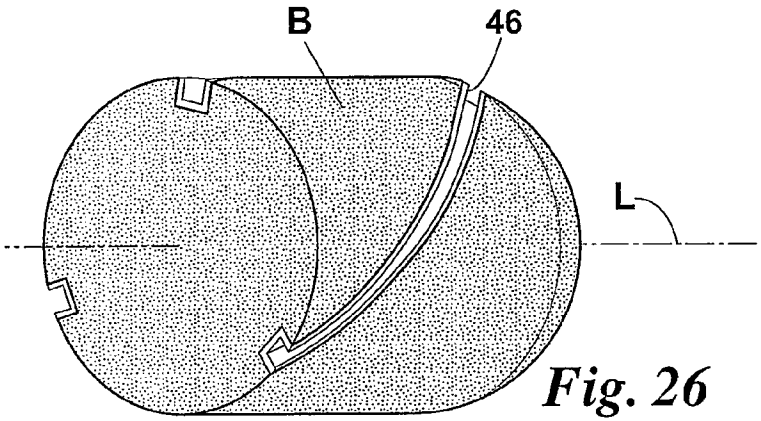
FIG. 26 is a rear isometric view of the foam type pig of FIG. 25.
Figure 25:
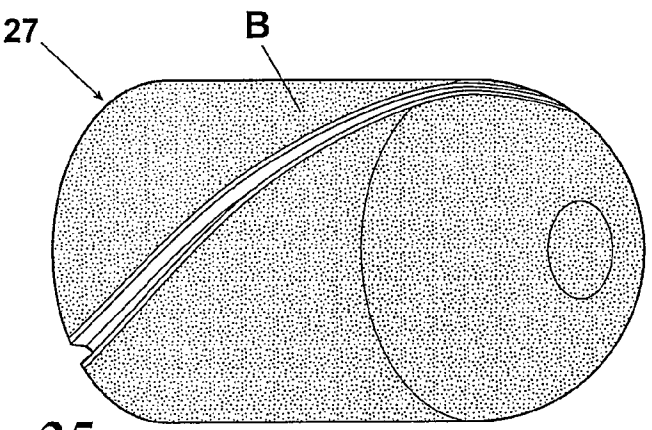
FIG. 25 is an isometric view of a foam type pig having the peeling edge of FIG. 1 spiraled about the pig body.
Figure 27:
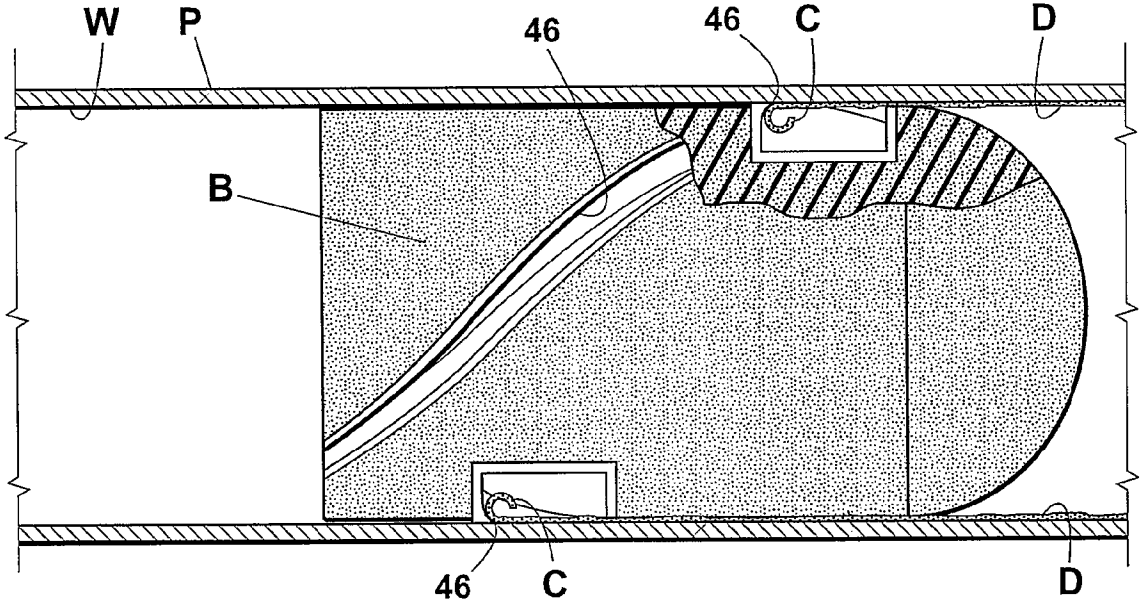
FIG. 27 is a view of the foam type pig of FIG. 25 in the pipeline restrained position and moving forward under differential pressure through a pipeline. The peeling edge urges against the pipeline wall to peel away debris in the manner illustrated in FIG. 1.

Last, referring to FIGS. 25 to 27, elastomeric member 10 is a foam type pig 27 having peeling edge 46 arranged oblique to the longitudinal axis L and spiraled about the pig body B. Because foam type pig 27 is oversized relative to the inside diameter of the pipeline P, peeling edge 27 urges against the pipeline wall W to peel away debris D in the manner illustrated in FIG. 1.

In all of the above embodiments, elastomeric member 10 provides a scraping element having a negative rake angle from the shearing edge that peels away paraffin and other debris from the interior surface of the pipeline. This peeling action peels the debris off the pipe wall much like a chip peels away from a cutting tool on a lathe.

While a pipeline debris shearing device has been described with a certain degree of particularity, many changes can be made in the details of construction and the arrangement of components without departing from the spirit and scope of this disclosure. Therefore, a pipeline debris shearing device made according to this disclosure is not limited to the preferred embodiments described, but is limited only by the scope of the attached claims, including the full range of equivalency to which each element thereof is entitled.

What is claimed is:

1. A cylindrical elastomeric member for use on a pipeline pig, the elastomeric member adapted for arrangement about a longitudinal body of the pipeline pig and comprising a plurality of spaced-apart teeth arranged about the elastomeric member, each tooth having a forward concave-shaped surface and an outer peripheral surface that meet to form a peeling edge that spans an entire distance from a front-most to a rear-most face surface of the elastomeric member, the elastomeric member having a first size in an unrestrained state that is larger than an inside diameter of a pipeline and a second size in a restrained state that is equal to the inside diameter of the pipeline.

2. An elastomeric member according to claim 1 further comprising each tooth being oriented at an oblique angle relative to a centerline of the elastomeric member.

3. An elastomeric member according to claim 1 further comprising a radial slot interspersed between at least one pair of adjacent teeth.

4. An elastomeric member according to claim 1 wherein the elastomeric member is cup-shaped.

* * * * *